United States Patent [19]

Laidig et al.

[11] Patent Number: 4,763,589

[45] Date of Patent: Aug. 16, 1988

[54] SOLAR POWERED INDICATING DEVICE FOR SEWING MACHINES

[75] Inventors: Manfred R. Laidig, Whippany; Stephen A. Garron, Elizabeth, both of N.J.

[73] Assignee: SSMC Inc., Stamford, Conn.

[21] Appl. No.: 107,190

[22] Filed: Oct. 13, 1987

[51] Int. Cl.[4] ..... D05B 79/00; D05B 45/00

[52] U.S. Cl. ..... 112/278; 323/906

[58] Field of Search ..... 112/278, 273, 121.11; 323/906

[56] References Cited

U.S. PATENT DOCUMENTS

| | | | |
|---|---|---|---|
| 4,237,807 | 12/1980 | Meier et al. | 112/278 |
| 4,333,411 | 6/1982 | Lerner | 112/278 |
| 4,692,683 | 9/1987 | Lalmond | 323/906 X |

*Primary Examiner*—Peter Nerbun

*Attorney, Agent, or Firm*—Robert E. Smith

[57] ABSTRACT

A solar cell powered detecting and indicating system applicable to mechanically controlled sewing machines without D.C. power supplies connected to regular A.C. house mains, and detecting and indicating circuits minimizing power consumption for compatability with solar generated power supply.

1 Claim, 2 Drawing Sheets

SOLAR POWERED INDICATING DEVICE FOR SEWING MACHINES

FIELD OF THE INVENTION

This invention relates to electronic indicating devices and associated sensing means for sewing machines requiring for operation low voltage rectified DC electric power; and more particularly, to a novel and cost effective arrangement for generating the DC power required to such indicating device without recourse to transformation and rectification of AC house current supply.

BACKGROUND OF THE INVENTION

With the advent of static electronic stitch pattern data circa 1974, sewing machines so equipped have routinely included DC power supply arrangements connected to the regular AC house mains. Since the cost and other disadvantages of such AC connected power supplies, such as disclosed for instance in U.S. Pat. No. 3,984,745, Oct. 5, 1976 of Minalga, are essential to and justified by the advantages of the electronic memory, such power supplies are available in electronic memory sewing machines also to supply other sensing and indicating devices; and indeed, numerous electronic sensing and indicating devices have been developed for use in electronically controlled sewing machines equipped with AC connected power supplies. One example of such a sensing and indicating device is a low bobbin thread detecting system as disclosed in U.S. Pat. No. 4,413,581, Nov. 8, 1983 of Logan which is incorporated herein by reference.

While is may be advantageous to incorporate or retrofit such a low bobbin thread detection system or other similar electronic sensing and indicating device in a sewing machine without electronic memory such as a cam controlled ornamental stitcher or a straight stitch sewing machine, the cost and disadvantage of an AC connected power supply has made such adaptation impractical.

SUMMARY OF THE INVENTION

It is an object of this invention to provide a highly cost effective mode for accommodating an electronic sensing and indicating device in a sewing machine which does not include an electronic stitch pattern memory by providing a power supply therefor utilizing a solar cell generating DC power from an illuminating lamp in the sewing machine.

Specifically it is an object of this invention to provide an electronic low bobbin thread detecting and indicating device for a mechanically controlled sewing machine powered by a solar cell arranged adjacent to the lamp which illuminates the sewing machine stitch forming area.

It is also an object of this invention to provide for an arrangement of the above character an improved operating circuit effective to minimize the power requirements of such detecting and indicating device thus to economize on the capacity of the required cell.

DETAILED DESCRIPTION OF THE PREFERRED EMBODIMENT

Figure 1:
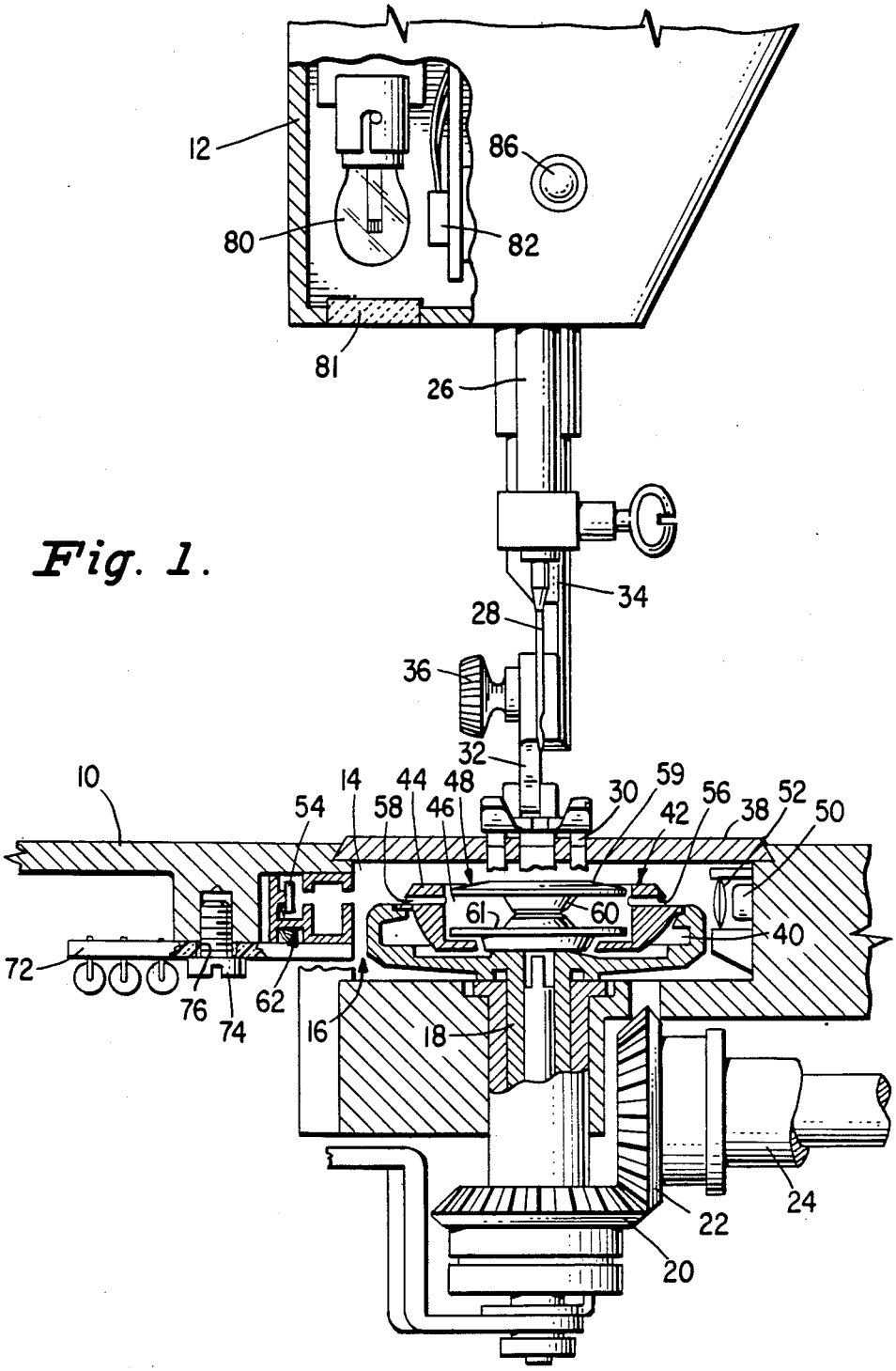
FIG. 1 is a front view partly in section of a portion of a sewing machine having a low bobbin thread detecting and indicating system together with a solar cell generated power supply therefor in accordance with the teachings of this invention.

Referring to the drawings, FIG. 1 shows a portion of a sewing machine having a bed 10 and a sewing head 12 overhanging the bed 10. The bed 10 contains a cavity 14 in which a loop taker 16 is rotatably carried on one extremity of a shaft 18 having a vertical axis. Fastened to the extremity of the shaft 18 opposite the loop taker 16 is a bevel gear 20 which is driven by a second bevel gear 22 fastened to a drive shaft, a fragment of which is shown at 24. The loop taker 16 rotates in timed synchronization to the reciprocation of a needle bar 26 which is reciprocatorily carried in the sewing haed 12. Fastened to the needle bar 26 is a needle 28 which is driven in endwise reciprocatory motion through a fabric supported on the sewing machine bed 10. The fabric may be moved along a line of feed on the bed 10 by the compound motion of a feed dog, a fragment of which appears at 30, which acts against the thrust of a presser foot 32 which is fastened to a presser bar 34 by a presser clamp 36. The feed dog 30 is driven in timed relation to the motion of the needle bar 26 by a mechanism which need not be understood for a full and complete understanding of the present invention. Preferably a slide plate 38 encloses a portion of the cavity 14. A throat plate (not shown) encloses the remainder of the cavity 14 and support the fabric against the thrust of the needle 28.

The loop taker 16 contains a cavity 40 in which is supported a bobbin case 42 whose periphery is defined by a wall 44. The bobbin case 42 is restrained from partaking of motion with the loop taker by means which are well known in the prior art. See for example, the U.S. Pat. No. 4,527,494 of W. Herron et al., July 9, 1985, the teachings of which are incorporated herein by reference. Contained within a cavity 46 in the bobbin case 42 is a bobbin 48 which may be filled with a quantity of thread for concatenation with thread carried by the needle 28 during the well known process of forming lockstitches. The bobbin 48 is freely rotatable within the bobbin case 42 in response to the withdrawal of thread therefrom during the sewing process.

It will be readily appreciated by one skilled in the art of sewing that it is inconvenient to exhaust the supply of bobbin thread while in the middle of a sewing project. Inasmuch as the bobbin is located within the sewing bed 10 over which is draped the garment or fabric being sewn, it will be appreciated that it is difficult to readily observe the quantity of thread remaining on the bobbin while carrying out the sewing process. To the end of alleviating the problems attendant with observing the quantity of bobbin thread, a mechanism which will signal the sewing machine operator to the approaching exhaustion of bobbin thread will find particular utility in minimizing the inconvenience of running out of bobbin thread during a sewing project.

The low bobbin thread detection system disclosed herein is carried out by placing a light source consisting (as but one example) of an infra-red light emitting diode 50 and a collimating lens 52 on one side of the loop taker 16 and a light sensitive photodetector 54 on the opposite side of the loop taker 16 distant from the light source. A first horizontal passageway 56 and a second horizontal passageway 58 are formed in the wall 44 of the bobbin case 42 so that the optical axes of the passageways 56 and 58 form an optical path which permits light radiated from the diode 50 to pass through the bobbin case 42 and impinge on the photodetector 54.

The optical axis formed by the passageways 56 and 58 is arranged in an optical alignment which traverses exteriorly of a central core 60 which is arranged between a pair of end flanges 58 and 61 at the center of the bobbin 48 so that when thread is wrapped around the core 60, light will not pass from the passageway 56 to the passageway 58. However, upon the consumption of a quantity of bobbin thread sufficient to expose the passageway 58 to transmission of light from the passageway 56, light will be allowed to pass therethrough and will illuminate the photodetector 54. The position of the passageways 56 and 58 relative to the core 60 is chosen so that when light traverses the path from the passageway 56 to the passageway 58, a sufficient quantity of bobbin thread will remain on the core 60 to permit the operator to discover the impending depletion of thread before fully exhausting the supply of bobbin thread.

Stray light which may be present in the vicinity of the photodetector 54 is precluded from impinging thereon and hence providing an erroneous indication of the impending exhaustion of bobbin thread by enclosing the photodetector 54 within a photodetector shielding means shown generally at 62.

Preferably the shield 62 is mounted on a board 72 to which are also fastened the electronic components which control a signaling means for warning the sewing machine operator of the impending depletion of bobbin thread. The board 72 is fastened to the sewing machine bed 10 by a fastener such as the screw 74 which passes through an elongated slot 76 and which constitute a means for aligning the photodetector 54 relative to the optical axes of the passageways 56 and 58 and the light source, by loosening the screw 74 and rotating the board 72 until the proper alignment is obtained.

As shown in FIG. 1 there is arranged within the sewing head 12 an electric light bulb 80 for illuminating the stitching area of the sewing machine preferrably through a lens 81. Adjacent the bulb 80 within the sewing head is arranged a solar cell 82 for generating power to activate the low bobbin detecting and indicating system. Also shown in FIG. 1 on the sewing head is an LED 86 for providing indication to the sewing machine operator of a sensed low bobbin thread condition.

Figure 2:
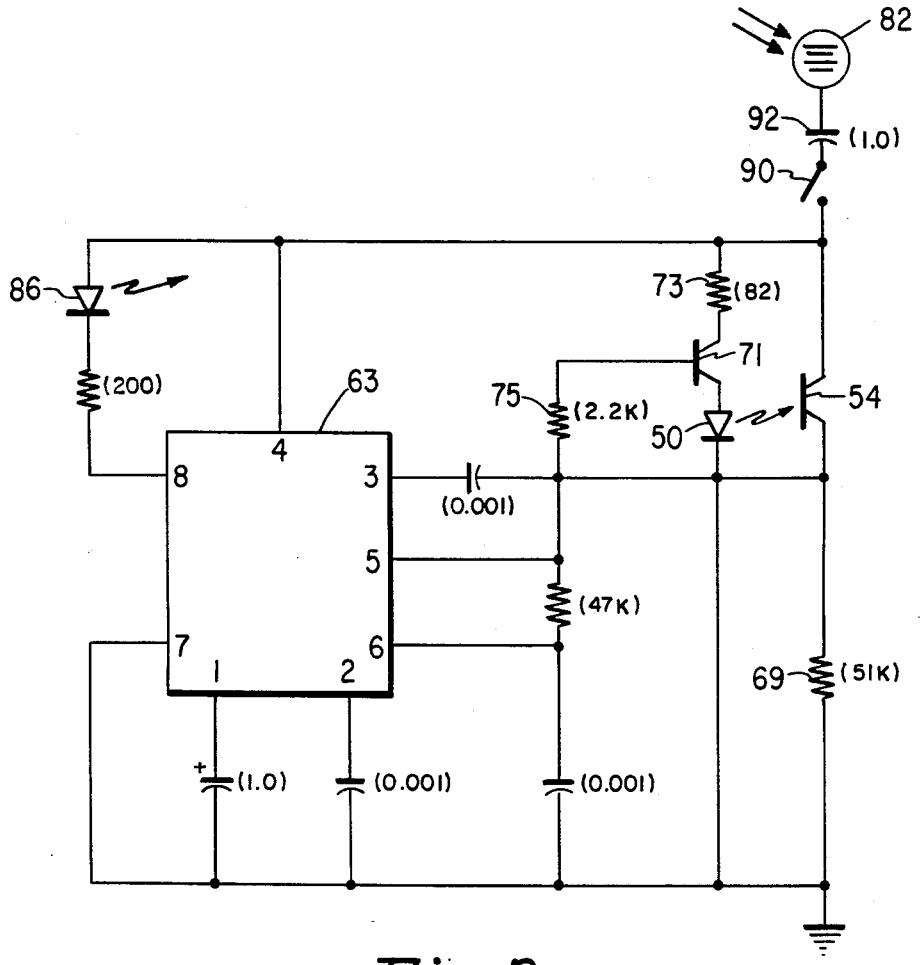
FIG. 2 is a schematic diagram of a preferred embodiment of an electrical circuit which may be used to activate the low bobbin thread detecting and indicating device.

Referring to FIG. 2, a circuit diagram is disclosed of a preferred arrangement for controlling the illumination of the LED 86 in response to impending bobbin thread exhaustion and driven by power generated by the solar cell 82. The circuit illustrated in FIG. 2 generally corresponds to that disclosed in the U.S. Pat. No. 4,413,581 incorporated herein by reference with modifications particularly suiting it to activation by solar cell generated power.

As shown in FIG. 2, a phase locked loop circuit 63 is used to control both the bobbin thread interrogating light source provided by the infra-red emitting diode 50, and the light detector 54 which may be a photo-transistor. The phase locked loop function is preferrably performed by a single integrated circuit chip, illustratively a type LM567/LM567C tone decoder manufactured by National Semiconductor. The transistor 71 and the resistors 73 and 75 provide a driver for the infra-red emitting diode 50 and the resistor 69 provides a current to voltage converter providing a signal to the phase locked loop circuit 63 when a light path through the bobbin is opened by impending bobbin thread exhaustion.

The numbers within the block 63 refer to the manufacturers terminal numbers. The numbers in parentheses next to the resistors and the capacitors are the resistance values in ohms and the capacitors values in microfarads, for a circuit embodiment which operates at a frequency of 2,300 Hertz.

In order to conserve the power generated by the solar cell 82 or, in other words, to operate a detection and signalling system with as small as possible solar cell, a normally open switch 90 may be positioned in the circuit between the solar cell 82 and the phase locked loop circuit 63 for isolating the solar cell and a charging capacitor 92 except during periodic switch closings. In a zig zag sewing machine employing a rotating stitch pattern cam the switch 90 may be connected for closure during only one of the plurality of stitches during each pattern cam rotation.

It will be appreciated that any other mode for periodically closing the switch 90 may also be utilized within the spirit of this invention to minimize the power consumption. It will also be appreciated that signalling means other than LED 86 may be utilized such as a sound emitting means for producing a beep or a chime.

Having set forth the nature of this invention what is claimed is:

1. In a sewing machine having stitch forming instrumentalities, a lighting device on said sewing machine, and means on said sewing machine for detecting and indicating a condition incident to the operation of said stitch forming instrumentalities, said detecting and indicating means including electronic elements requiring low voltage D. C. power supply, and a solar cell positioned on said sewing machine for response to illumination from said lighting device for generating the power supply required by said electronic elements of said detecting and indicating means, in which switch means are provided between said solar cell generated power supply and said detecting and indicating means, and in which means driven by said sewing machine are provided for alternately opening and closing said switch means to provide for intermittent operation of said detecting and indicating means.

* * * * *